US010294750B2

(12) United States Patent
Aitken et al.

(10) Patent No.: US 10,294,750 B2
(45) Date of Patent: May 21, 2019

(54) DOWNHOLE TOOL HAVING ADJUSTABLE AND DEGRADABLE RODS

(71) Applicant: Halliburton Energy Services, Inc., Houston, TX (US)

(72) Inventors: Liam A. Aitken, Carrollton, TX (US); Michael L. Fripp, Carrollton, TX (US); John C. Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 120 days.

(21) Appl. No.: 14/911,701

(22) PCT Filed: Jan. 29, 2015

(86) PCT No.: PCT/US2015/013593
§ 371 (c)(1),
(2) Date: Feb. 11, 2016

(87) PCT Pub. No.: WO2016/122544
PCT Pub. Date: Aug. 4, 2016

(65) Prior Publication Data

US 2016/0369592 A1 Dec. 22, 2016

(51) Int. Cl.
*E21B 34/06* (2006.01)
*E21B 43/12* (2006.01)

(52) U.S. Cl.
CPC ..... *E21B 34/063* (2013.01); *E21B 43/12* (2013.01)

(58) Field of Classification Search
CPC ..... E21B 43/08; E21B 43/103; E21B 33/12; E21B 33/13; E21B 34/063; E21B 43/12
See application file for complete search history.

(56) References Cited

U.S. PATENT DOCUMENTS 7,699,101 B2 4/2010 Fripp et al.
8,967,275 B2 * 3/2015 Crews ..... E21B 29/00 166/300
2008/0236843 A1 10/2008 Scott et al.
2009/0223665 A1 * 9/2009 Colley, III ..... E21B 43/26 166/280.1

(Continued)

FOREIGN PATENT DOCUMENTS

WO 2014098903 A1 6/2014
WO 2015163889 A1 10/2015

OTHER PUBLICATIONS

International Search Report and Written Opinion dated Sep. 30, 2015; PCT International Application No. PCT/US2015/013593.

*Primary Examiner* — Nicole Coy
*Assistant Examiner* — Yanick A Akaragwe
(74) *Attorney, Agent, or Firm* — McGuireWoods LLP

(57) ABSTRACT

A downhole assembly comprising: a tubing string located within a wellbore; an outer housing located around a portion of the tubing string; an annulus located between the outside of the tubing string and the inside of the outer housing; at least one flow path through the annulus; an inflow control device positioned within the flow path; and a degradable rod, wherein the degradable rod fits into the flow path adjacent to the inflow control device, and wherein the degradable rod is positionable within the flow path or removable from the flow path. The downhole assembly can be used in an oil or gas operation to variably control the amount of a fluid flowing through the annulus.

23 Claims, 7 Drawing Sheets

(56) References Cited

U.S. PATENT DOCUMENTS

| | | | | |
|---|---|---|---|---|
| 2011/0024111 | A1* | 2/2011 | Moen | E21B 43/08 166/278 |
| 2013/0264072 | A1* | 10/2013 | Lopez | E21B 43/08 166/386 |
| 2013/0327540 | A1* | 12/2013 | Hamid | E21B 33/12 166/376 |
| 2014/0020898 | A1 | 1/2014 | Holderman et al. | |
| 2014/0216733 | A1* | 8/2014 | Mathiesen | E21B 34/08 166/252.5 |
| 2014/0262207 | A1 | 9/2014 | Lopez | |
| 2014/0301523 | A1* | 10/2014 | Son | G21D 1/00 376/277 |
| 2014/0305630 | A1 | 10/2014 | Kang et al. | |
| 2015/0053419 | A1* | 2/2015 | Garcia | E21B 34/08 166/373 |
| 2015/0308238 | A1* | 10/2015 | Langlais | E21B 34/06 166/278 |

* cited by examiner

DOWNHOLE TOOL HAVING ADJUSTABLE AND DEGRADABLE RODS

TECHNICAL FIELD

Downhole tools are used in a variety of oil and gas operations. A rod can be installed within a flow passage of the downhole tool. The rod can be dissolvable such that the rod degrades to provide a temporary fluid restriction through the flow passage. A multitude of rods can also be easily removed and replaced within the flow passage.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
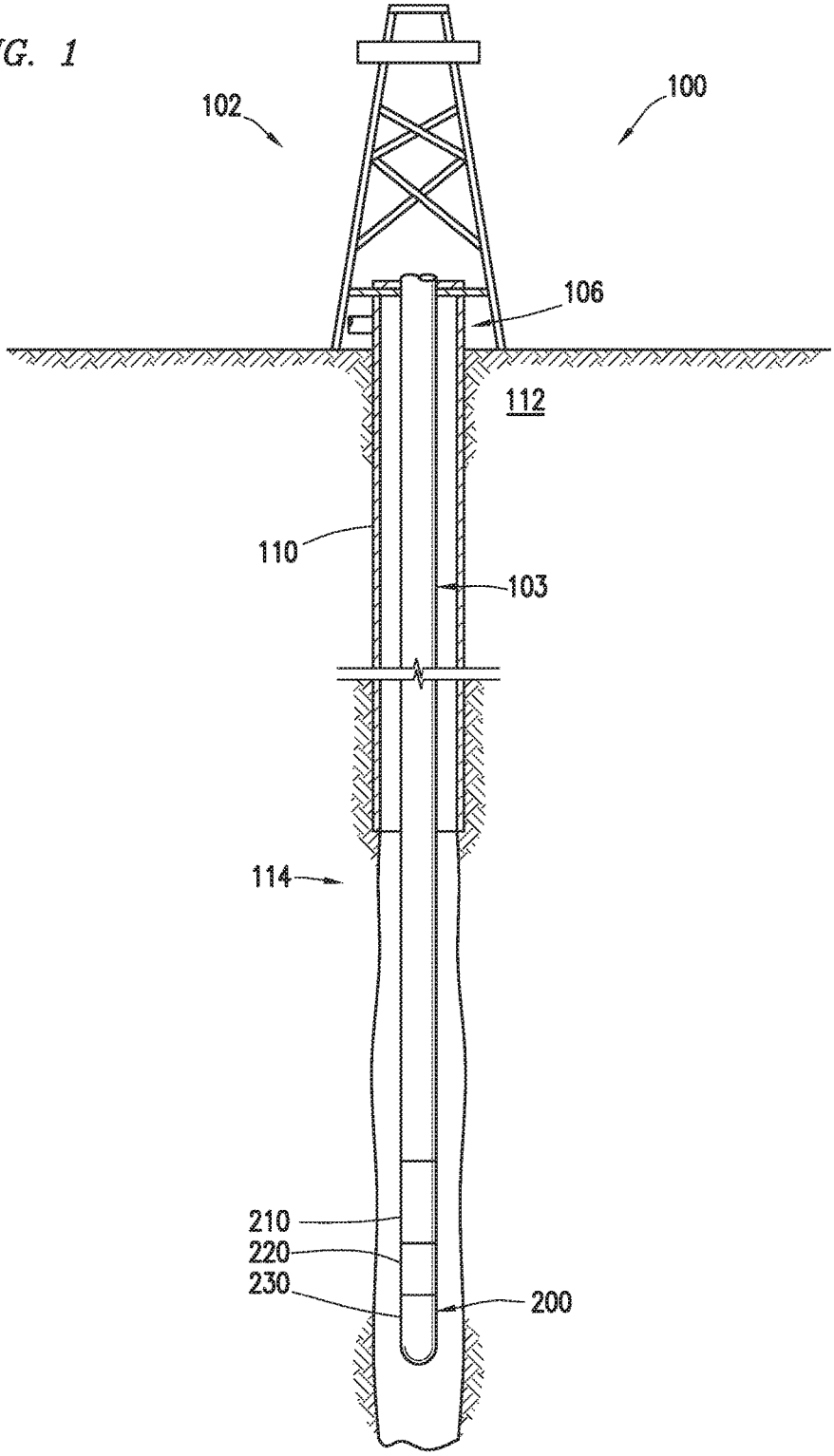
FIG. 1 is an illustration of a well system.

Oil and gas hydrocarbons are naturally occurring in some subterranean formations. In the oil and gas industry, a subterranean formation containing oil and/or gas is referred to as a reservoir. A reservoir can be located on land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

A well can include, without limitation, an oil, gas, or water production well or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore into the near-wellbore region via the wellbore.

A portion of a wellbore can be an open hole or cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

During production of reservoir fluids, the reservoir fluid can flow from the subterranean formation and into the wellbore and a production tubing string. During injection operations, the flow of fluid is reversed, from a tubing string within the wellbore and into the subterranean formation. A variety of downhole assemblies can be used during oil and gas operations. An example of a downhole assembly is a sand screen assembly. Inflow control devices (ICD) are another example of a downhole assembly and can be used to variably restrict the flow rate of fluids flowing through the wellbore, for example in a particular wellbore interval. An ICD can be installed within an annulus between an outer diameter of a tubing string and an inner diameter of an outer housing of another assembly.

It may be desirable to temporarily restrict fluid flow past an inflow control device. A rod can be installed at a location below the ICD to restrict fluid flow through the ICD. The rod can be made from a degradable material that degrades after a desired period of time in order to establish fluid communication through the ICD or the rod can be made from a non-degradable material that continues to restrict fluid communication through the ICD for the life of the wellbore. However, the rods are generally installed adjacent to the ICD within the downhole assembly such that once installed, it is very difficult to replace the plugs or rods at the well site or to switch between degradable and non-degradable materials. Therefore, multiple downhole assemblies may have to be transported and stored at a well site in order to customize the variables for the specific wellbore operation. Thus, there is a need for being able to temporarily restrict fluid flow through an ICD while at the same time, allowing for on-the-fly adjustment and modification of the rods used. As used herein, the term "rod" is used to mean any shape of the member for obstructing or restricting the flow and can be cylindrical, spherical, oblong, corpuscular, or any other shape that can provide a restriction to the flow path.

It has been discovered that a downhole assembly can include one or more adjustable flow paths whereby one or more rods can be inserted and removed easily from an area adjacent to an ICD to selectively control fluid flow through the downhole assembly. The rods can easily be switched out at the well site, which provides an operator with the ability to use one downhole assembly and selectively install a variety of rods to provide the optimum flow scheme through the downhole assembly.

According to an embodiment, a downhole assembly comprises: a tubing string located within a wellbore; an outer housing located around a portion of the tubing string; an annulus located between the outside of the tubing string and the inside of the outer housing; at least one flow path through the annulus; an inflow control device positioned within the flow path; and a degradable rod, wherein the degradable rod fits into the flow path adjacent to the inflow control device, and wherein the degradable rod is positionable within the flow path or removable from the flow path.

According to another embodiment, a method of controlling the amount of a fluid through an annulus comprises: providing a downhole assembly, wherein the downhole assembly comprises: (A) an outer housing located around a portion of a tubing string; (B) the annulus located between the outside of the tubing string and the inside of the outer housing; (C) at least one flow path through the annulus; (D) an inflow control device positioned within the flow path; and (B) a degradable rod, wherein the degradable rod fits into the flow path adjacent to the inflow control device; positioning the rod into the flow path or removing the rod from the flow path and positioning a second degradable rod into the flow path; positioning the downhole assembly within a wellbore; and causing or allowing at least a portion of the degradable rod to degrade.

According to yet another embodiment, a well system comprises: a wellbore; a tubing string located within the wellbore; an outer housing located around a portion of the tubing string; an annulus located between the outside of the tubing string and the inside of the outer housing; at least one flow path through the annulus; an inflow control device positioned within the flow path; and a degradable rod, wherein the degradable rod its into the flow path adjacent to the inflow control device, and wherein the degradable rod is positionable within the flow path or removable from the flow path.

Any discussion of the embodiments regarding the downhole assembly or any component related to the downhole assembly is intended to apply to all of the apparatus, system, and method embodiments.

It should be understood that, as used herein, "first," "second," "third," etc., are arbitrarily assigned and are merely intended to differentiate between two or more flow paths, rods, inflow control devices, etc., as the case can be, and does not indicate any particular orientation or sequence. Furthermore, it is to be understood that the mere use of the term "first" does not require that there be any "second," and the mere use of the term "second" does not require that there be any "third," etc.

Turning to the Figures, FIG. 1 depicts a well system 100. The well system 100 can include well surface or well site 106. Various types of equipment, such as a rotary table, drilling fluid or production fluid pumps, drilling fluid tanks (not expressly shown), and other drilling, stimulation, or production equipment can be located at well surface or well site 106. For example, well site 106 can include drilling rig 102 that can have various characteristics and features associated with a "land drilling rig." However, other drilling equipment located on offshore platforms, drill ships, semi-submersibles and drilling barges (not expressly shown) can also be used for off-shore drilling operations.

The well system 100 can include at least one wellbore 114. The wellbore 114 can penetrate a subterranean formation 112. The subterranean formation 112 can be a portion of a reservoir or adjacent to a reservoir. The wellbore 114 can include a casing 110. The wellbore 114 can have a generally vertical uncased section extending downwardly from the casing 110, as well as a generally horizontal uncased section extending through the subterranean formation 112. The wellbore 114 can alternatively include only a generally vertical wellbore section, or can alternatively include only a generally horizontal wellbore section. The wellbore 114 can include a heel and a toe (not shown).

A tubing string, for example a production string 103, can be used to produce reservoir fluids from the subterranean formation 112 or inject fluids into the formation via the wellbore 114. The tubing string can be secured in the wellbore 114 by setting packers (not shown) against a casing 110 or an open-hole section of the wellbore 114, or by cementing the tubing string in the wellbore with cement, etc. The well system 100 can comprise one or more wellbore intervals. At least one wellbore interval can correspond to a zone of the subterranean formation 112.

The well system 100 can also include a downhole assembly 200 connected to a tubing string, such as a production string 103. The downhole assembly 200 can be used to perform operations relating to the completion of the wellbore 114, the production of reservoir fluids, injection operations, and/or the maintenance of the wellbore 114. The downhole assembly 200 can include a wide variety of components configured to perform these operations. For example, the downhole assembly 200 can include a sand screen assembly 210, an inflow control device 220, and an adjustable flow path 230. The downhole assembly 200 can also include other components, including, but not limited to, slotted tubing, packers, valves, sensors, and actuators. The number and types of components included in the downhole assembly 200 can depend on the type of wellbore, the operations being performed in the wellbore, and the anticipated wellbore conditions.

Figure 2A:
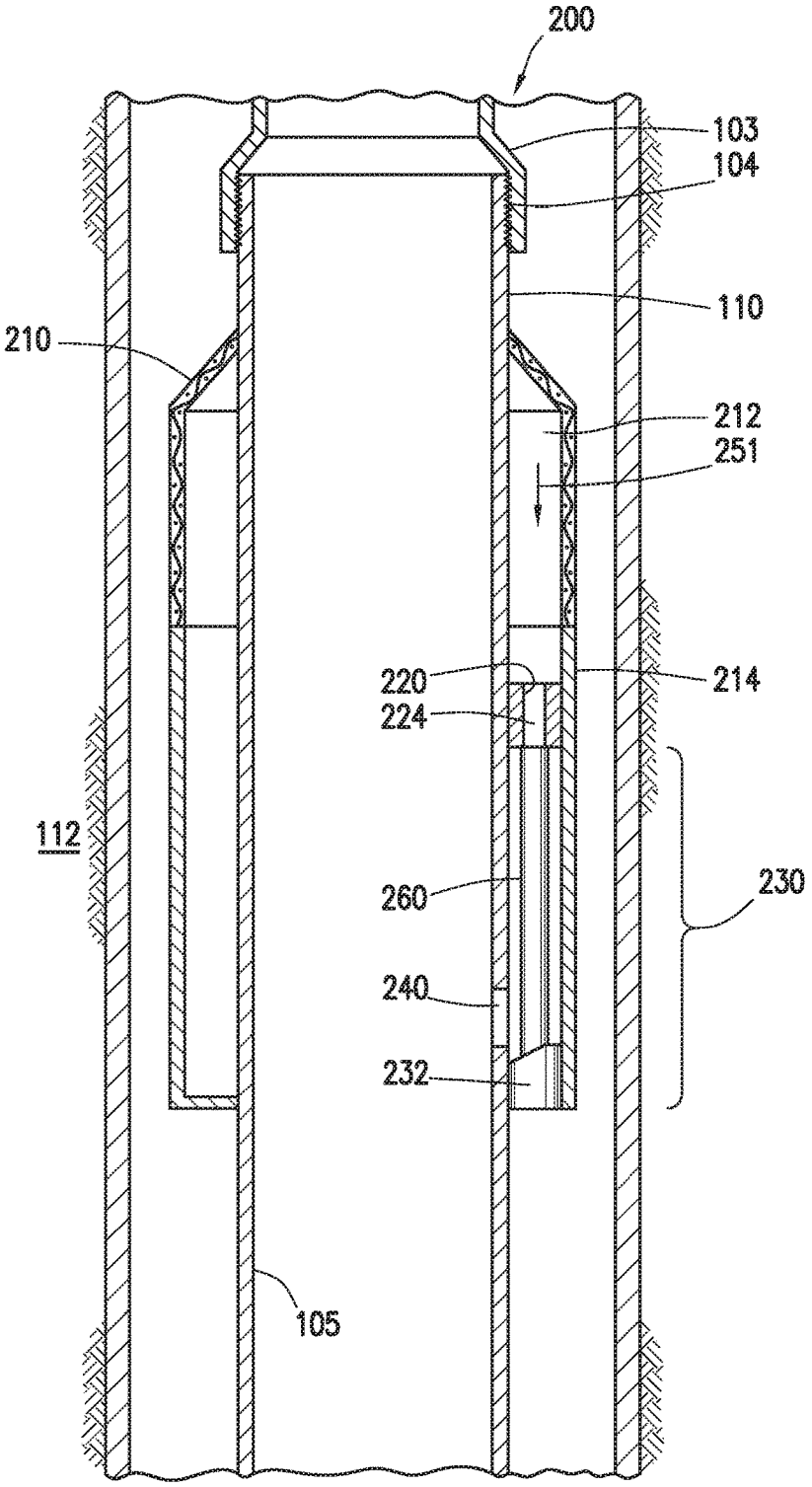
FIGS. 2A and 2B are cross-sectional views of a downhole assembly including an adjustable flow path, with and without a rod, respectively.
Figure 2B:
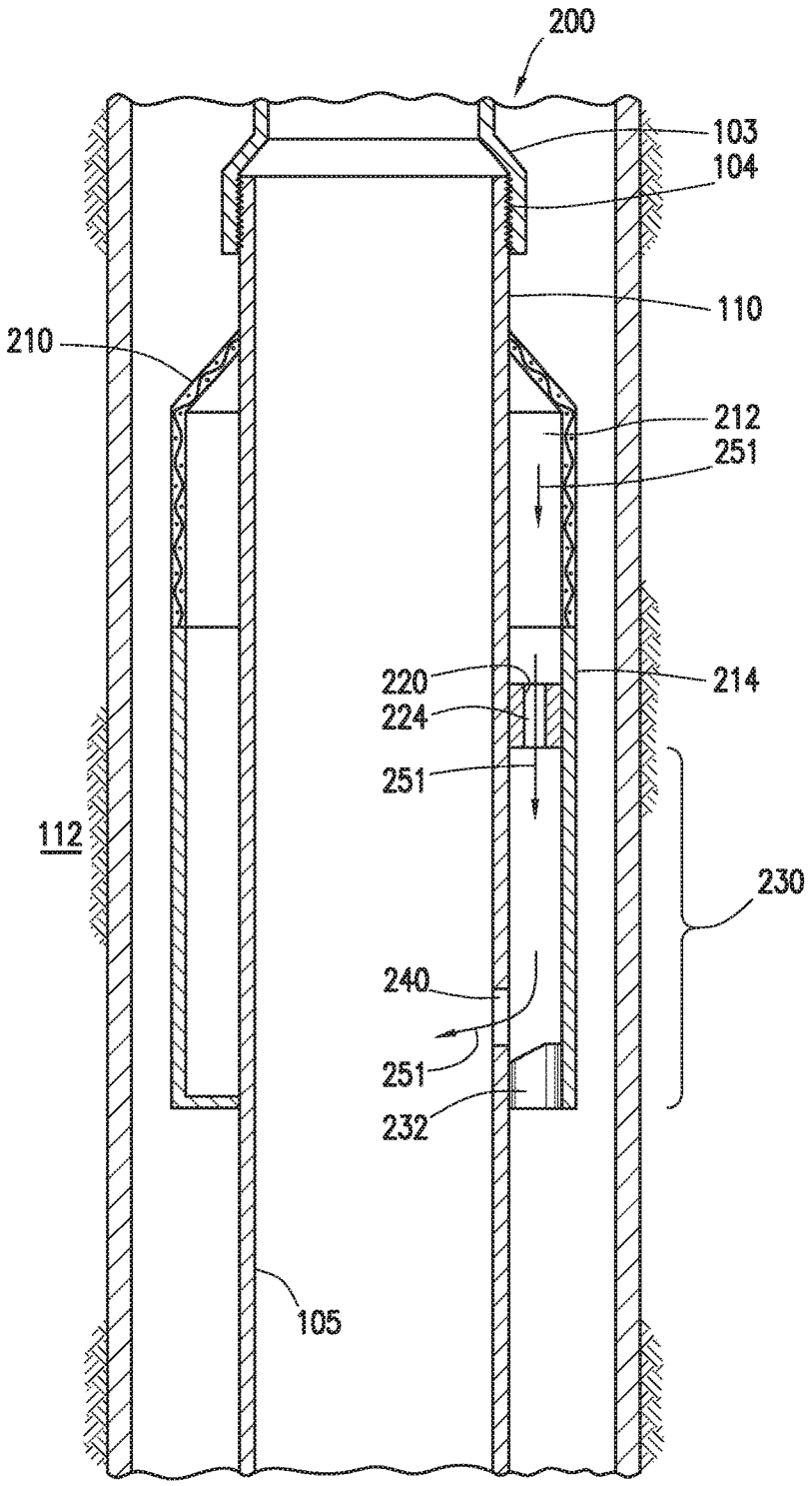

FIGS. 2A and 2B are illustrations of the downhole assembly 200. The production string 103 can be coupled to a tubing string 105 via a threaded joint 104. The downhole assembly 200 can include the sand screen assembly 210 and an outer housing 214. The outer housing 214 is located around a portion of the tubing string 105. An annulus 212 is located between the outside of the tubing string 105 and the inside of the outer housing 214. The annulus 212 contains at least one flow path through the annulus 212, shown as fluid flowing in direction 251. An inflow control device 220 can be positioned within the flow path. The inflow control device 220 can include a flow passage 224 that can allow fluids to flow through the inflow control device 220. The inflow control device 220 can be any device that restricts the flow of fluids through the flow path. The inflow control device 220 can be a passive inflow control device such as a nozzle, an orifice, or a tube. The inflow control device 220 can be an autonomous inflow control device such as a vortex diode assembly or a component with a moving plate.

Figure 4A:
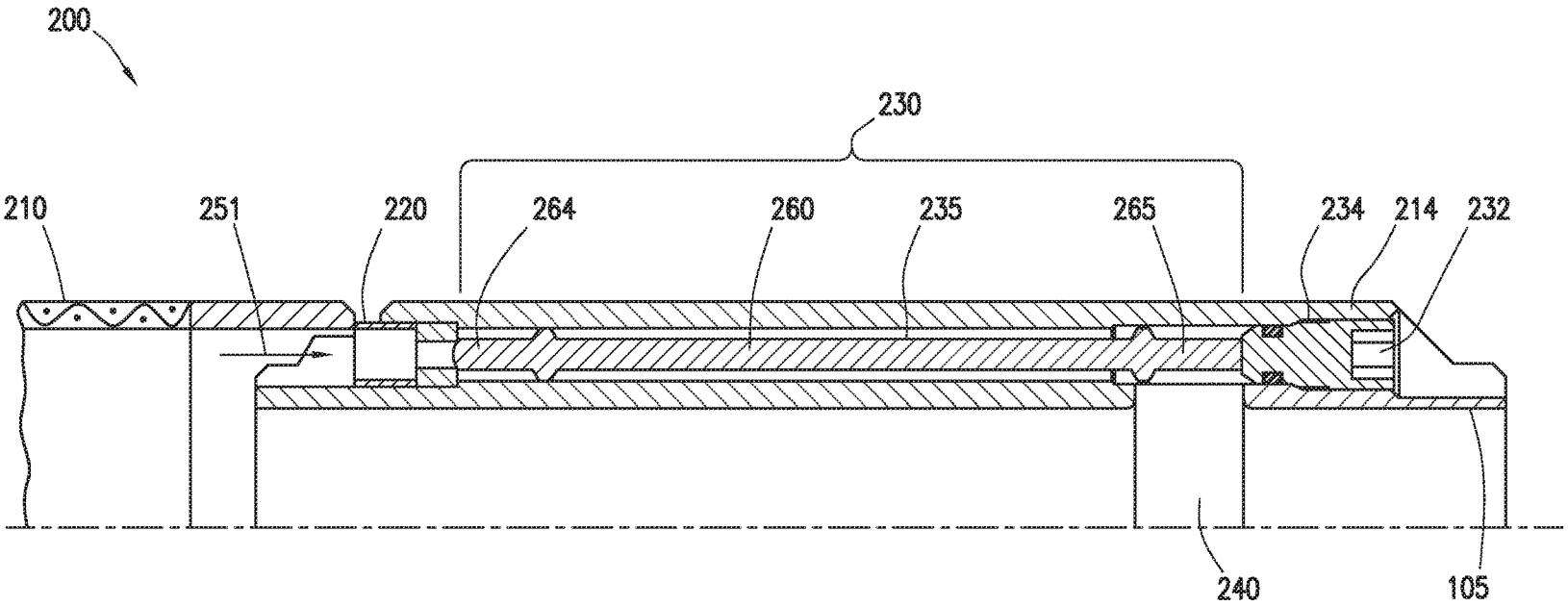
FIGS. 4A and 4B are enlarged illustrations of the downhole assemblies of FIGS. 2A and 2B.
Figure 4B:
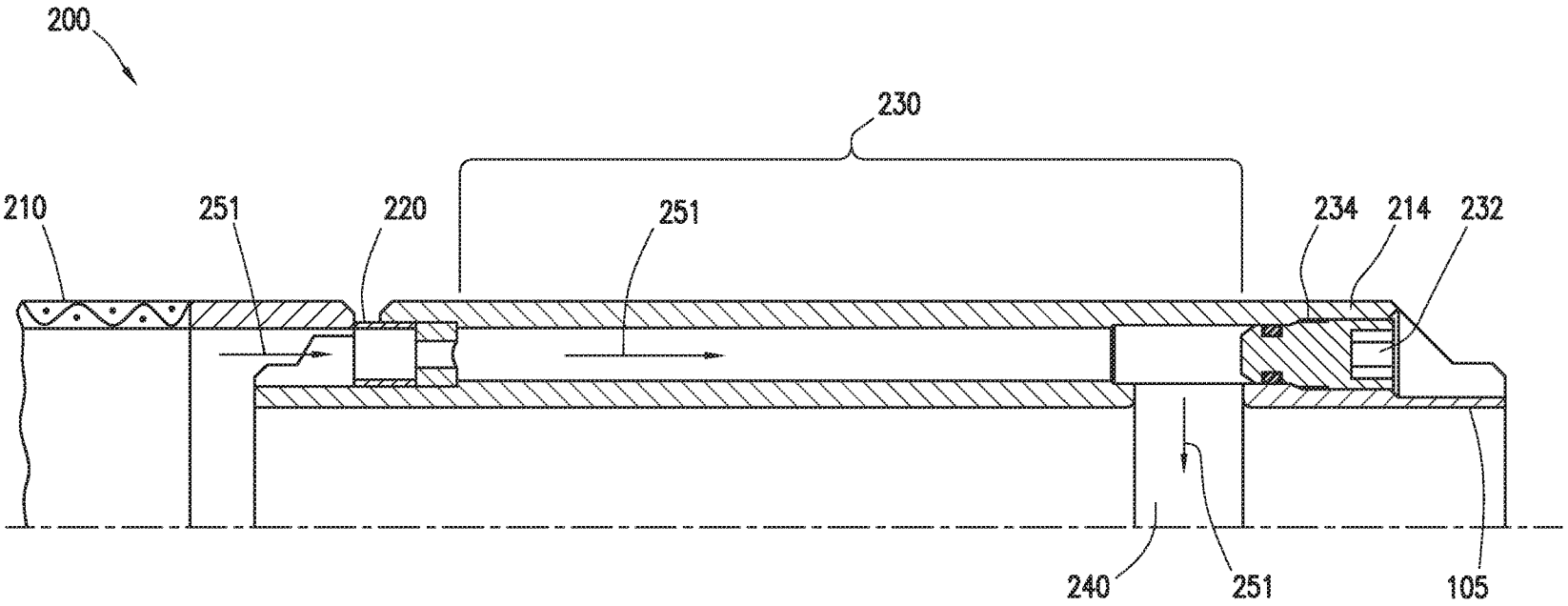

FIGS. 4A and 4B depict a cross-sectional view of the downhole assembly 200. The downhole assembly 200 also includes an adjustable flow path 230. A degradable rod 260 can fit into the adjustable flow path 230 adjacent to the inflow control device 220. The degradable rod 260 can be fitted into the adjustable flow path 230 and secured within the flow path via a plug 232. By way of example, the degradable rod 260 can be positioned within the adjustable flow path 230 and the plug 232 can then be threadingly connected to the outer housing 214 via threads 234 (shown in FIG. 4A for example). The plug 232 can help prevent the degradable rod 260 from moving out of the adjustable flow path 230. The degradable rod 260 can be positionable within the a unstable flow path 230. The degradable rod 260 can also be removable from the adjustable flow path 230. In order to remove the degradable rod 260, the plug 232 can be removed, for example, by unthreading the connection with the outer housing 214, unsnapping rings or collets, etc. A second end 265 of the degradable rod 260 that is located adjacent to the plug 232 can contain a threaded female end for receiving a threaded male end of a removal tool. The removal tool can mate with the second end 265 of the degradable rod 260 and be used to pull or remove the degradable rod 260 from the adjustable flow path 230. One of the advantages to the downhole assembly 200 is the ability to quickly and easily switch out different rods within the adjustable flow path 230. The rods can be inserted into the flow path and removed from the flow path at the well site to achieve the desired configuration of the downhole assembly. In this manner, the interchangeability of the rods means that the multiple assemblies do not have to be transported to a well site to accommodate the different wellbore conditions that may be experienced. Thus, issues regarding cost and storage space are minimized.

According to certain embodiments, the degradable rod 260 and the downhole assembly 200 are configured such that when the degradable rod 260 is fitted within the adjustable flow path 230, a first end 264 of the rod is in sealing engagement with the inflow control device 220. In this manner, fluid flow through the inflow control device 220 is prevented due to this sealing engagement. If the rod does not maintain sealing engagement with the ICD, then issues can occur such as premature fluid flow through the ICD. The downhole assembly 200 can further include a biasing device, such as a spring, (not shown) that is located between the second end 265 of the degradable rod 260 and the plug 232. The spring can be a coil spring, a flexure, a Bellville spring, an elastic solid, or any other method of providing a pre-load on the sealing surface. The biasing device can maintain the first end 264 of the degradable rod 260 in sealing engagement with the inflow control device 220.

By way of another example, the thermal expansion coefficient of some or all of the degradable rod 260 can be selected to match the thermal expansion coefficient of the housing of the inflow control device 220, wherein the matching of the thermal expansion coefficients maintains the first end of the rod in sealing engagement with the ICD. The thermal expansion should be matched such that one of the materials will exceed their yield stress while exposed through the expected temperature variation. In practice, this means that the thermal expansion coefficient, values are considered matched when they are within +/−50% of each other, but this matching will vary with the material properties and with the operating temperature range. By way of example, the housing of the ICD can be made from steel. Accordingly, the materials selected to make up the degradable rod 260 can be selected to match the thermal expansion coefficient of the steel housing. This can be accomplished by selecting, materials and their respective concentrations to provide a thermal expansion coefficient, that matches the steel. For example, magnesium has a higher thermal expansion coefficient than steel. Therefore, the degradable rod 260 can be made from a mixture of magnesium and another material that has a lower thermal expansion coefficient than steel, such as ceramic, glass, or Invar.

As can be seen in FIGS. 2A and 4A, when the degradable rod 260 is fitted within the adjustable flow path 230 adjacent to the inflow control device 220, then fluid flow can be prevented from flowing past the degradable rod 260 and into or from the tubing string 105 via port 240. By contrast, and as can be seen in FIGS. 2B and 4B, when the degradable rod has degraded, then fluid can flow through the adjustable flow path 230 and into or from the tubing string 105 via the port 240, for example in direction 251.

The degradable rod 260 is made from one or more materials that degrade. As used herein, the term "degrade" means a chemical process in which the degradable materials dissolve or break down into smaller components. The degradable materials can be selected from metals, metal alloys, sugars, salts, degradable polymers such as polylactic acid or polyglycolic acid, thiol polymer, and combinations thereof. The metal or metal of the metal alloy can be selected from the group consisting of, lithium, sodium, potassium, rubidium, cesium, francium, beryllium, magnesium, calcium, strontium, barium, radium, aluminum, gallium, indium, tin, thallium, lead, bismuth, scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold, graphite, and combinations thereof. Preferably, the metal or metal alloy is selected from the group consisting of magnesium, aluminum, tungsten, iron, nickel, copper, zinc, and combinations thereof. It is to be understood that as used herein, the term "metal" is meant to include pure metals and also metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is ZK60, comprising the metallic elements magnesium, zirconium, and zinc.

The degradable materials can degrade in a degrading fluid. The chemical process by which the degradable materials degrade can be dissolution, hydrolysis, or galvanic corrosion. Galvanic corrosion occurs when two different metals or metal alloys are in electrical connectivity with each other and both are in contact with an electrolyte. As used herein, the phrase "electrical connectivity" means that the two different metals or metal alloys are either touching or in close enough proximity to each other such that when the two different metals are in contact with an electrolyte, the electrolyte becomes electrically conductive and on migration occurs between one of the metals and the other metal, and is not meant to require an actual physical connection between the two different metals, for example, via a metal wire. Galvanic corrosion can also occur with certain metals in the presence of an electrolyte without a distinct cathode being present. Galvanic corrosion in this occurrence is also intended to include micro-galvanic corrosion in which a solid solution of a metal alloy creates local regions within the grain, between the grains, or amongst the grains of different galvanic potentials.

The degrading fluid can include water, oils, alcohols, an acid, or an electrolyte. As used herein, an electrolyte is any substance containing free ions (i.e., a positive- or negative-electrically charged atom or group of atoms) that make the substance electrically conductive. The electrolyte can be selected from the group consisting of, solutions of an acid, a base, a salt, and combinations thereof. A salt can be dissolved in water, for example, to create a salt solution. Common free ions in an electrolyte include sodium ($Na^+$), potassium ($K^+$), calcium ($Ca^{2+}$) magnesium ($Mg^{2+}$), chloride ($Cl^-$), hydrogen phosphate ($HPO_4^{2-}$), and hydrogen carbonate ($HCO_3^-$). The concentration (i.e., the total number of free ions available in the electrolyte) of the electrolyte can be adjusted to control the rate of dissolution of the degradable materials of the degradable rod 260. The degrading fluid can be a fluid that is introduced into the wellbore 114 or a reservoir fluid that is produced from a reservoir.

The rate of degradation of the degradable rod 260 can be adjustable and predetermined based on a desired time that fluid is to be prevented from flowing through the inflow control device 220 prior to degradation of the rod. According to certain embodiments, the degradable rod 260 degrades in a desired amount of time. Some of the factors that can affect the rate of degradation of the degradable rod 260 include the type and concentration of the anode and cathode of a galvanic system, the concentration and temperature of the degrading fluid (e.g., an electrolyte), the amount of surface area that is available to come in contact with the degrading fluid, etc. According to certain embodiments, the outer diameter of the degradable rod 260 is less than the inner diameter of the outer housing 214. Accordingly, a gap or space can exist between the outside of the rod and the inside of the housing along the length of the rod.

Figure 6:
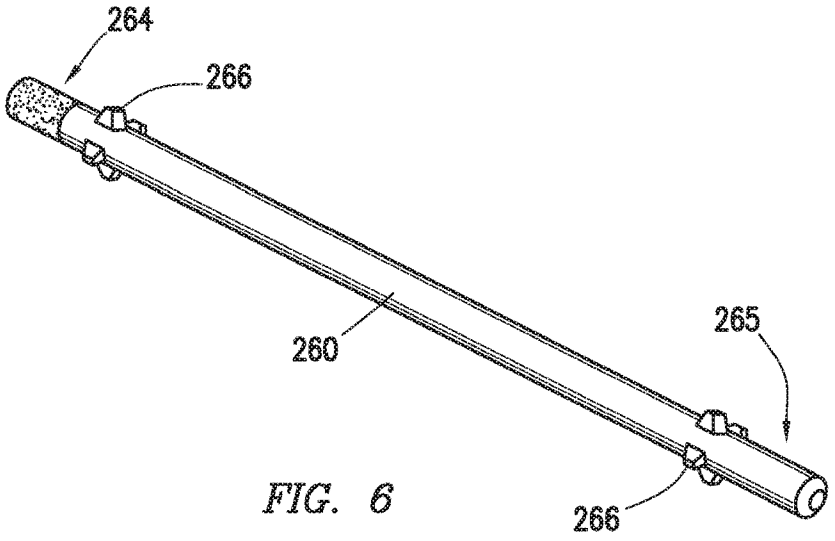
FIG. 6 is another illustration of the rod according to other embodiments.
Figure 5:
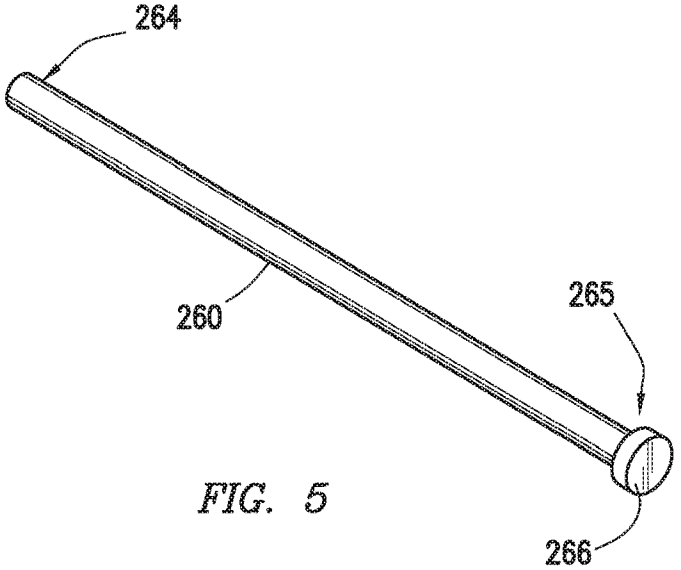
FIG. 5 is an illustration of the rod according to certain embodiments.

As can be seen in FIGS. 5 and 6, the degradable rod 260 can include one or more centralizers 266. The centralizers 266 can be located on the outside of the degradable rod 260 and at one or more locations along a longitudinal axis of the rod. For example, as depicted in FIG. 5, a centralizer 266 can be located at the second end 265. This centralizer 266 can fit into a recessed portion on the mating end of the plug 232. By way of another example, as depicted in FIG. 6, the centralizers 266 can be a protrusion extending away from the surface of the rod. There can be multiple protrusions that can extend circumferentially around the outside of the rod. According to certain embodiments, the centralizer(s) 266 support the degradable rod 260 within the adjustable flow path 230 such that a micro-annulus 235 is formed between the outside of the degradable rod 260 and the inside of the outer housing 214 (for example, as shown in FIGS. 4A and 4B). It should be understood that the degradable rod 260 does not have to be perfectly "centered" within the adjustable flow path 230, so long as at least a portion of the surface circumference along the rod's length forms the micro-annulus 235. In this manner, the degrading fluid can come in contact with the portion of the surface or all of the surface of the degradable rod 260. The amount of surface area of the degradable rod 260 that comes in contact with the degrading fluid can be adjusted by the number and location of the one or more centralizers 266. For example, when the entire circumference of the rod along most or all of the length creates the micro-annulus 235, then the greater amount of surface area is available to come in contact with the degrading fluid and thus, the faster the rate of degradation of the degrading materials of the degradable rod.

The degradable rod 260 can also include one or more pores. The porosity of the rod can be selected to provide a desired rate of degradation and the desired amount of time of the degradation. Generally, the greater the porosity, the faster the degradation rate because more of the degrading fluid can penetrate into the degradable rod 260 to cause degradation.

The degradable rod 260 can also be a hollow rod with caps on one or both ends. The thickness of the walls of the rod can be selected to provide a desired rate of degradation and the desired amount of time of the degradation. Generally, the thinner the walls, the quicker the rod will degrade.

The first end 264 and/or the second end 265 of the degradable rod 260 can be made from a different material or materials compared to the rest of the degradable rod 260. FIG. 6 illustrates the first end 264 of the degradable rod 260 being made from different materials than the rest of the rod. The different materials can be selected to degrade in a different degrading fluid compared to the rest of the degradable rod 260. By way of example, the different materials can be selected such that the materials are non-reactive to an acidic fluid used to perform a wellbore cleanup operation. The acidic wellbore fluid can be circulated throughout the wellbore without flowing through the inflow control device 220 due to the non-reactive first end 264 that is in sealing engagement with the ICD. After the cleanup operation has been performed, then a different wellbore fluid can be introduced into the wellbore or a reservoir fluid can be produced. The different materials making up the first end 264 can then degrade in the different wellbore fluid to allow fluid flow into the micro-annulus 235 to come in contact with the rest of the degradable rod 260. Alternatively, the degradable materials making up the rest of the rod can be selected to degrade in the acidic cleanup fluid. The cleanup fluid can be circulated into the inside of the tubing string 105, through the port 240, and into the micro-annulus 235. The acidic fluid can then begin to degrade the rod except for the non-reactive first end 264. For example, the first end 264 could be composed of a non-reactive material such as an epoxy, an elastomer, a ceramic, a plastic, or a non-reactive metal like copper or stainless steel. The non-reactive first end 264 would prevent the acid in the cleanup operation from reaching the degradable rod 260. In another example, the first end 264 could be composed of a slow-reactive material such as an epoxy, an elastomer, a plastic, a coating, or a slow-reacting metal alloy. In this case, the slow-reactive first end 264 would allow the acid in the cleanup operation to be distributed through the wellbore but would not prevent the degradation process.

The different materials of the first and/or second ends 264/265 of the degradable rod 260 can also be selected to provide a different degradation rate than the rest of the degradable rod 260 using the same degrading fluid. For example, the concentration of the materials making up the first end 264 can be different from the rest of the degradable rod 260 such that the first end 264 degrades within the degrading fluid at a faster or slower rate than the rest of the rod. The degradation rate of the first and/or second ends 264/265 can be selected to speed up or delay fluid from flowing into the micro-annulus 235 to come in contact with the rest of the rod.

Figure 3:
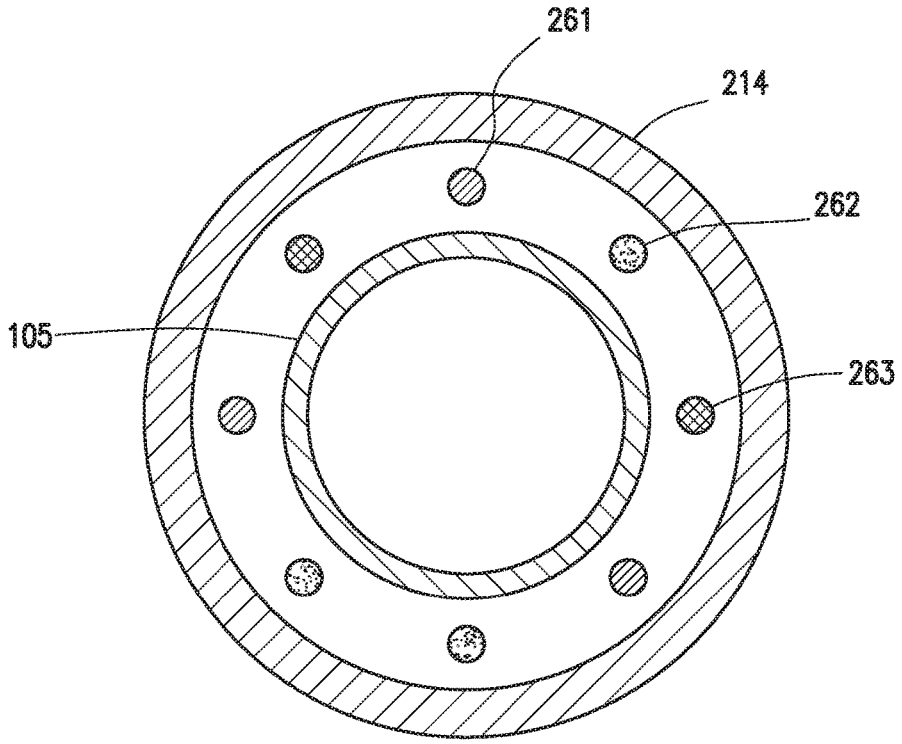
FIG. 3 is a cross-sectional view of the adjustable flow path showing three different types of rods.

Turning to FIG. 3, the well system 100 and the downhole assembly 200 can include more than one inflow control device 220, flow passage 224, adjustable flow path 230, and degradable rod 260 and/or non-degradable rod. The exact number of ICDs, flow paths, etc. can be selected based on the specific oil and gas operation to be performed and the desired timing and flow rate through the various ICDs. The more than one adjustable flow paths 230 can include different types of rods, wherein at least one of the types of rods is the degradable rod 260. The other type(s) of rods can also be degradable or non-degradable. For example, one or more of the adjustable flow paths 230 can include a first type of rod 261, a second type of rod 262, and/or a third type of rod 263.

The following is but one example of a multitude of configurations of the downhole assembly 200. It should be understood that any of a number of configurations can be utilized. For example, a fourth, fifth, etc. type of rod can be used. The first type of rod 261 can be made from a non-degradable material, such as steel, so fluid flow through the ICD is permanently prevented. The second type of rod 262 can be made from a material that degrades in a first type of degrading fluid, for example, an injection fluid. When this first type of degrading fluid comes in contact with the second type of rod 262, then degradation occurs and fluid flow is permitted through the ICD and the corresponding adjustable flow path 230. The third type of rod 263 can be made from a material that degrades in a second type of degrading fluid (e.g., a produced reservoir fluid), but not the first type of degrading fluid. In this manner, the third type of rod 263 will remain intact without degrading until it comes in contact with the second type of degrading fluid. After contact with the second type of degrading fluid, the third type of material degrades to permit fluid flow through the ICD and corresponding adjustable flow path. The rods can also be made from different materials such that the rods degrade at different rates from one another.

The downhole assembly 200 can easily be configured at the well site by removing one or more of the different types of rods and positioning other rods within the adjustable flow paths 230, as discussed above. The downhole assembly can also be removed from the wellbore in order to switch out one or more of the rods based on actual wellbore conditions. This adjustability of the downhole assembly is but one of numerous advantages to the downhole assembly.

The methods include positioning the degradable rod 260 into the adjustable flow path 230 or removing the degradable rod and positioning a second degradable rod into the flow path. The methods also include positioning the downhole assembly within a wellbore. The step of positioning can include running the downhole assembly within the wellbore, for example, on a tubing string.

The methods also include causing or allowing at least a portion of the degradable rod to degrade. According to certain embodiments, at least a sufficient amount of the degradable rod degrades to permit fluid flow through the ICD and the adjustable flow path. The step of causing can include introducing the degrading fluid into the wellbore to come in contact with the degradable rod. The step of allowing can include producing a reservoir fluid from the subterranean formation.

It should be noted that the well system 100 is illustrated in the drawings and is described herein as merely one example of a wide variety of well systems in which the principles of this disclosure can be utilized. It should be clearly understood that the principles of this disclosure are not limited to any of the details of the well system 100, or components thereof, depicted in the drawings or described herein. Furthermore, the well system 100 can include other components not depicted in the drawing.

Therefore, the present system is well adapted to attain the ends and advantages mentioned as well as those that are inherent therein. The particular embodiments disclosed above are illustrative only, as the principles of the present disclosure can be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above can be altered or modified and all such variations are considered within the scope and spirit of the principles of the present disclosure.

As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that can be incorporated herein by reference, the defections that are consistent with this specification should be adopted.

What is claimed is:

1. A well system comprising:

a wellbore;

a tubing string located within the wellbore;

an outer housing located around a portion of the tubing string;

an annulus located between the outside of the tubing string and the inside of the outer housing;

at least one flow path through the annulus;

an inflow control device positioned within the flow path; and a degradable rod, wherein the degradable rod is in sealing engagement to prevent flow of fluids through the annulus, the degradable rod fits into an adjustable flow path adjacent to the inflow control device, the degradable rod is positionable within the flow path or removable from the flow path, wherein the degradable rod is degradable by galvanic corrosion, wherein the degradable rod is configured such that when the degradable rod is fitted within the adjustable flow path, a first end of the rod is in sealing engagement with the inflow control device, wherein the thermal expansion coefficient of some or all of the degradable rod is selected to match the thermal expansion coefficient of the housing of the inflow control device, wherein the matching of the thermal expansion coefficients maintains the first end of the rod in sealing engagement with the inflow control device.

2. The system according to claim 1, wherein the degradable rod is fitted into the adjustable flow path and secured within the flow path via a plug.

3. The system according to claim 1, further comprising a biasing device located between an end of the degradable rod that is adjacent to a plug, wherein the biasing device maintains the first end of the degradable rod in sealing engagement with the inflow control device.

4. The system according to claim 1, wherein the degradable rod comprises one or more degradable materials selected from the group consisting of metals, metal alloys, degradable polymers, and combinations thereof.

5. The system according to claim 4, wherein the one or more degradable materials degrade in a degrading fluid.

6. The system according to claim 5, wherein the degrading fluid comprises water, oils, alcohols, an acid, an electrolyte, and combinations thereof.

7. The system according to claim 4, wherein the degradable rod further comprises a first section with a first degradation rate and a second section with a second degradation rate.

8. The system according to claim 7, wherein the second section comprises one or more materials selected from the group consisting of an epoxy, an elastomer, a ceramic, a plastic, a metal, or a metal alloy.

9. The system according to claim 8, wherein the one or more materials does not degrade.

10. The system according to claim 1, wherein the degradable rod degrades in a desired amount of time.

11. The system according to claim 10, wherein the degradable rod comprises one or more centralizers.

12. The system according to claim 11, wherein the one or more centralizers support the degradable rod within the adjustable flow path such that a micro-annulus is formed between the outside of the degradable rod and the inside of the outer housing.

13. The system according to claim 10, wherein the degradable rod further comprises one or more pores, and wherein the porosity of the rod is selected to provide degradation in the desired amount of time.

14. The system according to claim 1, further comprising more than one inflow control device and adjustable flow path.

15. The system according to claim 14, wherein the more than one adjustable flow paths are fitted with different types of rods, wherein at least one of the types of rods is the degradable rod.

16. The system according to claim 15, wherein the other types of rods are degradable or non-degradable.

17. The system according to claim 16, wherein the flow scheme through the more than one inflow control devices are configured at the well site by removing one or more of the different types of rods and positioning other rods within the adjustable flow paths.

18. The system according to claim 1, wherein the inflow control device is a passive inflow control device.

19. The system according to claim 1, wherein the inflow control device is an autonomous inflow control device.

20. A method of controlling the amount of a fluid through an annulus comprising:

providing a downhole assembly, wherein the downhole assembly comprises:

(A) an outer housing located around a portion of a tubing string;

(B) the annulus located between the outside of the tubing string and the inside of the outer housing;

(C) at least one flow path through the annulus;

(D) an inflow control device positioned within the flow path; and (E) a degradable rod, wherein the degradable rod is in sealing engagement to prevent flow of fluids through the annulus, the degradable rod fits into the flow path adjacent to the inflow control device, positioning the degradable rod into the flow path or removing the degradable rod from the flow path and positioning a second degradable rod of a different type into the flow path;

positioning the downhole assembly within a wellbore; and causing or allowing at least a portion of the degradable rod to degrade, wherein the degradable rod is configured such that when the degradable rod is fitted within the adjustable flow path, a first end of the rod is in sealing engagement with the inflow control device, wherein the thermal expansion coefficient of some or all of the degradable rod is selected to match the thermal expansion coefficient of the housing of the inflow control device, wherein the matching of the thermal with the inflow control device.

21. The method according to claim 20, wherein the step of causing comprises introducing a degrading fluid into the wellbore to come in contact with the degradable rod.

22. The method according to claim 20, wherein the step of allowing comprises producing a reservoir fluid from a subterranean formation.

23. A downhole assembly comprising:

a tubing string located within a wellbore;

an outer housing located around a portion of the tubing string;

an annulus located between the outside of the tubing string and the inside of the outer housing;

at least one flow path through the annulus;

an inflow control device positioned within the flow path; and a degradable rod, wherein the degradable rod is degradable by galvanic corrosion and is in sealing engagement to prevent flow of fluids through the annulus, the degradable rod fits into the flow path adjacent to the inflow control device, the degradable rod is positionable within the flow path or removable from the flow path, wherein the degradable rod is configured such that when the degradable rod is fitted within the adjustable flow path, a first end of the rod is in sealing engagement with the inflow control device, wherein the thermal expansion coefficient of some or all of the degradable rod is selected to match the thermal expansion coefficient of the housing of the inflow control device, wherein the matching of the thermal expansion coefficients maintains the first end of the rod in sealing engagement with the inflow control device.

* * * * *